United States Patent [19]

De Feo

[11] Patent Number: 4,946,418

[45] Date of Patent: Aug. 7, 1990

[54] ROTATING DRUM MAGAZINE FOR STORING AND MANAGING COINS IN TELEPHONE SETS OR DISPENSERS

[75] Inventor: Carlo De Feo, Napoli, Italy

[73] Assignee: I.P.M. Industria Politecnica Medidionale S.p.A., Napoli, Italy

[21] Appl. No.: 378,425

[22] Filed: Jul. 10, 1989

Related U.S. Application Data

[63] Continuation of Ser. No. 1,605, filed as PCT IT86/00026 on Mar. 27, 1986, published as WO86/05907 on Oct. 9, 1986, abandoned.

[30] Foreign Application Priority Data

Apr. 5, 1985 [IT] Italy ..... 47933

[51] Int. Cl.[5] ..... G07D 1/00

[52] U.S. Cl. ..... 453/20; 453/40; 221/83

[58] Field of Search ..... 453/18, 20, 22, 32, 453/33, 34, 36, 39, 40, 42, 49, 57; 194/346, 350, 351; 221/76, 82, 83, 86, 87, 89, 90, 265, 277

[56] References Cited

U.S. PATENT DOCUMENTS

| | | | |
|---|---|---|---|
| 1,625,979 | 4/1927 | Brinkerhoff | 453/49 |
| 1,753,248 | 4/1930 | Nutt | 221/90 X |
| 2,144,545 | 1/1939 | Peters | 194/350 X |
| 2,251,755 | 8/1941 | Peters | 453/57 X |
| 3,415,256 | 12/1968 | Meloni | 453/40 X |
| 4,202,362 | 5/1980 | Kashio | 453/49 X |
| 4,219,297 | 8/1980 | Tsukui | 221/89 X |
| 4,236,649 | 12/1980 | Fellner et al. | 221/90 |
| 4,491,240 | 1/1985 | Ruskin et al. | 221/90 X |
| 4,519,522 | 5/1985 | McElwee | 221/79 X |
| 4,836,825 | 6/1989 | Smeets et al. | 194/351 X |

FOREIGN PATENT DOCUMENTS

| | | | |
|---|---|---|---|
| 0143972 | 6/1985 | European Pat. Off. | 453/49 |
| 3541869 | 6/1987 | Fed. Rep. of Germany | 453/40 |
| 0600453 | 6/1978 | Switzerland | 453/49 |
| 2022897 | 12/1979 | United Kingdom | 194/346 |
| 2070307 | 9/1981 | United Kingdom . | |
| 80/01117 | 5/1980 | World Int. Prop. O. | 453/49 |

*Primary Examiner*—F. J. Bartuska
*Attorney, Agent, or Firm*—Blum Kaplan

[57] ABSTRACT

A rotating drum magazine for storing and managing coins having a rotating drum formed with a plurality of compartments for receiving coins and a hinged bottom and which rotates in a radial direction between an open and closed position is provided. A driving arm rotatable in two directions selectively opens a hinged bottom. The angle of rotation of the driving arm is coded through coded discs associated with the rotating drum and is controlled by a logic control unit which causes the driving arm to selectively open and close the compartments for dispensing of the coins.

6 Claims, 3 Drawing Sheets

ROTATING DRUM MAGAZINE FOR STORING AND MANAGING COINS IN TELEPHONE SETS OR DISPENSERS

This is a continuation application of U.S. patent application Ser. No. 07/001,605 filed as PCT IT86/00026 on Mar. 27, 1986, published as WO86/05907 on Oct. 9, 1986, now abandoned.

The present invention relates to an automatic monetary apparatus collecting and changing coins and small money and rendering a public utility service like for example a public telephone apparatus, and more in particular a rotating drum magazine housed therein for storing and managing coins and small money which are then collected and/or selectively changed.

It is an object of this invention to provide a coin storing and managing apparatus which is not depending upon the dimensions of the coins variable in thickness and diameter according to the issuing States and to the currency and the coniage of new coins.

Another object of the present invention is to provide a coin storing and managing apparatus allowing, in particular in the phone service, an optimized payment corresponding to the greatest extent to the telephone rate.

A further object of the present invention is to provide an apparatus allowing the managing of the coins to be released from the sequence of putting coins in the slot of the apparatus so that the coins can be changed and returned only according to a cash logic.

Still another object of the present invention is to provide a coin storing and managing apparatus that is free from channels of predetermined size which could not be followed by newly issued coins having dimensions larger than those of the channels.

The above mentioned objects are achieved by providing in a monetary apparatus for vending goods and/or services, in particular a telephone apparatus of public utility, an automatic coin storing and managing apparatus in form of a rotating drum magazine or socalled "revolver" comprising as characterized in the claims a controlled step rotating drum provided with vertical compartment located radially along the periphery or a circle ring at the same distance from the center and having all the same angular extension and being opened at the upper and lower sides so as to allow the coins from a feeding duct to pass through the drum whichever diameter and thickness they have after being put in the slot and recognized by a coin selection system already known. The vertical compartments are each provided at their lower sides with closure means able to retain the coins fallen down in the compartment which thus acts as a pocket. The rotating drum magazine further comprises a closure means driving mechanism which is coaxial to the drum and also controlled-step rotatable. Therefore, since an electronic control unit of conventional type is able to sense by means of coded discs the instant setting angle of both the drum and the closure means driving mechanism as well as the value of the coins located in the single pockets and recognized and validated by the selection system, the apparatus either can cash or change the coins in order to exactly meet the service requirements.

The features of the invention will be more readily apparent from the following description of a preferred embodiment taken in connection with the accompanying drawings, wherein.

Figure 1:
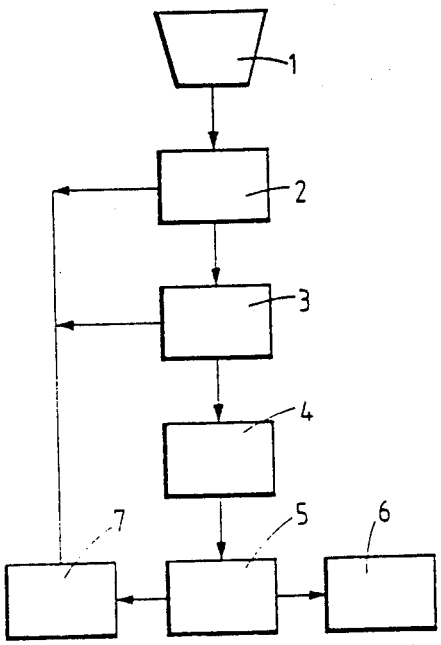
FIG. 1 is a block diagram schematically showing a sequence of operation of the rotating drum magazine according to the present invention in an automatic coin cashing and changing apparatus.

Referring to the drawing in FIG. 1 it is schematically shown a sequence of operation of an automatic coin cashing and changing apparatus embodying a coin storing and managing magazine according to the present invention. The block 1 denotes the introduction of a coin into the apparatus; the block 2 denotes a first selection between a coin and a piece which is not a coin by means of a mechanical filter. In the latter case the piece is given back to the user in the block 7; in the former case the coin is passed over to a second selection in the block 3 where it is recognized. If the coin is not validated, i.e. it is not included among those admissible by the apparatus, it is passed over to the block 7 to be returned to the user. On the contrary if the coin is accepted, it is stored and managed in the block 4.

Managing means that one or more or simultaneously all the coins are passed over to the next block 5 in which it is decided to cash the coins in the block 6 or to return them to the user in the block 7.

Figure 3:
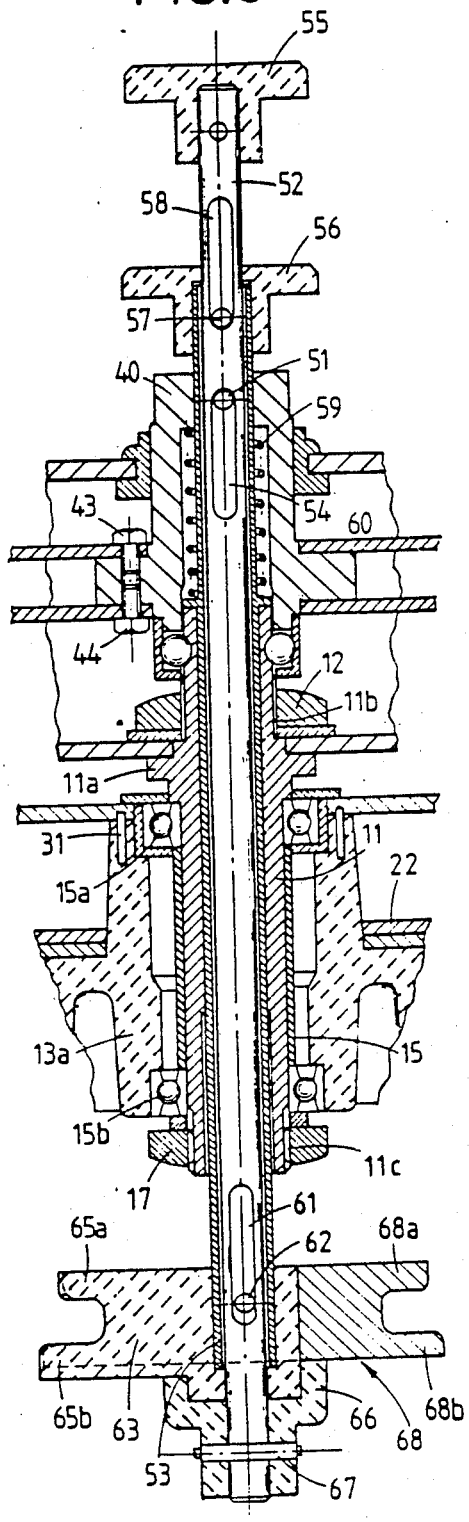
FIG. 3 is a longitudinal, axial section in enlarged scale of the central part of the magazine.
Figure 2:
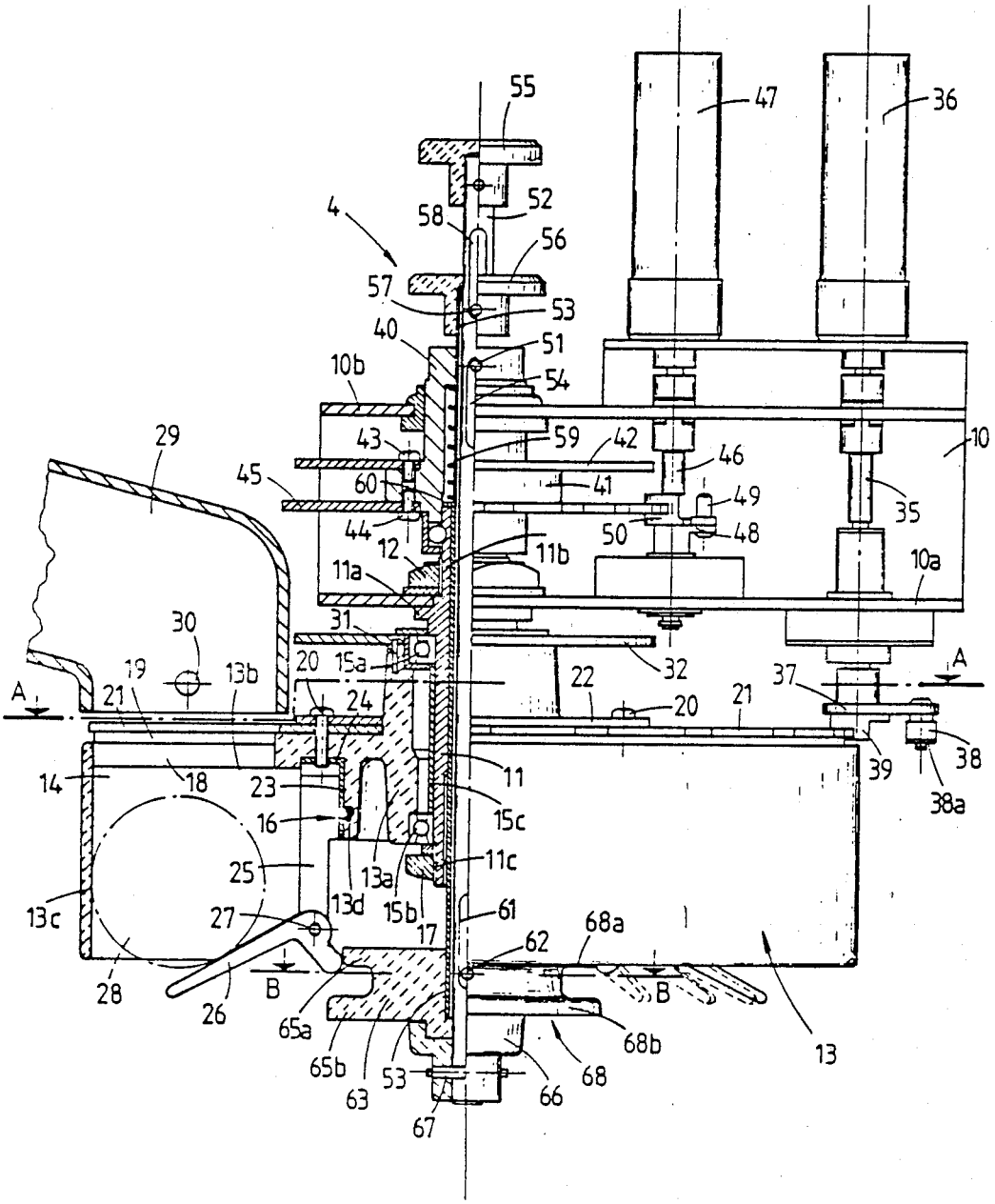
FIG. 2 is a front elevation view partially sectioned of a rotating drum magazine according to the present invention.

A rotating drum magazine or so called "revolver" contained in the block 4 and shown as a whole in FIG. 2 and in the enlarged central portion of FIG. 3 is used to provide the storing and the managing of the coins. In the above mentioned figures the number 10 denotes a supporting plate of a public telephone apparatus automatically cashing and changing small money or as mentioned above a different automatic apparatus dispensing products or services of variable amount. The supporting plate 10 consists of a channel located horizontally. A sleeve 11 extending above and below the flange **10*a* of the channel and fixedly connected to the latter by threaded couplings is placed vertically passing through a hole in the lower flange 10*a* of the supporting plate channel 10. The sleeve 11 abuts with an annular projection 11*a* against the lower side of the flange 10*a* and is fastened on the upper side of the latter by means of a nut 12 screwed on a threaded portion 11*b* of the sleeve 11. Coaxially fitted about the sleeve 11 below the base plate 10 a rotating drum 13 is able to rotate on a pair of bearings 15*a* and 15*b* separated from each other by means of a spacer 15*c* and fastened by a nut 17 screwed at the lower threaded end 11*c* of the sleeve 11**.

Figure 4:
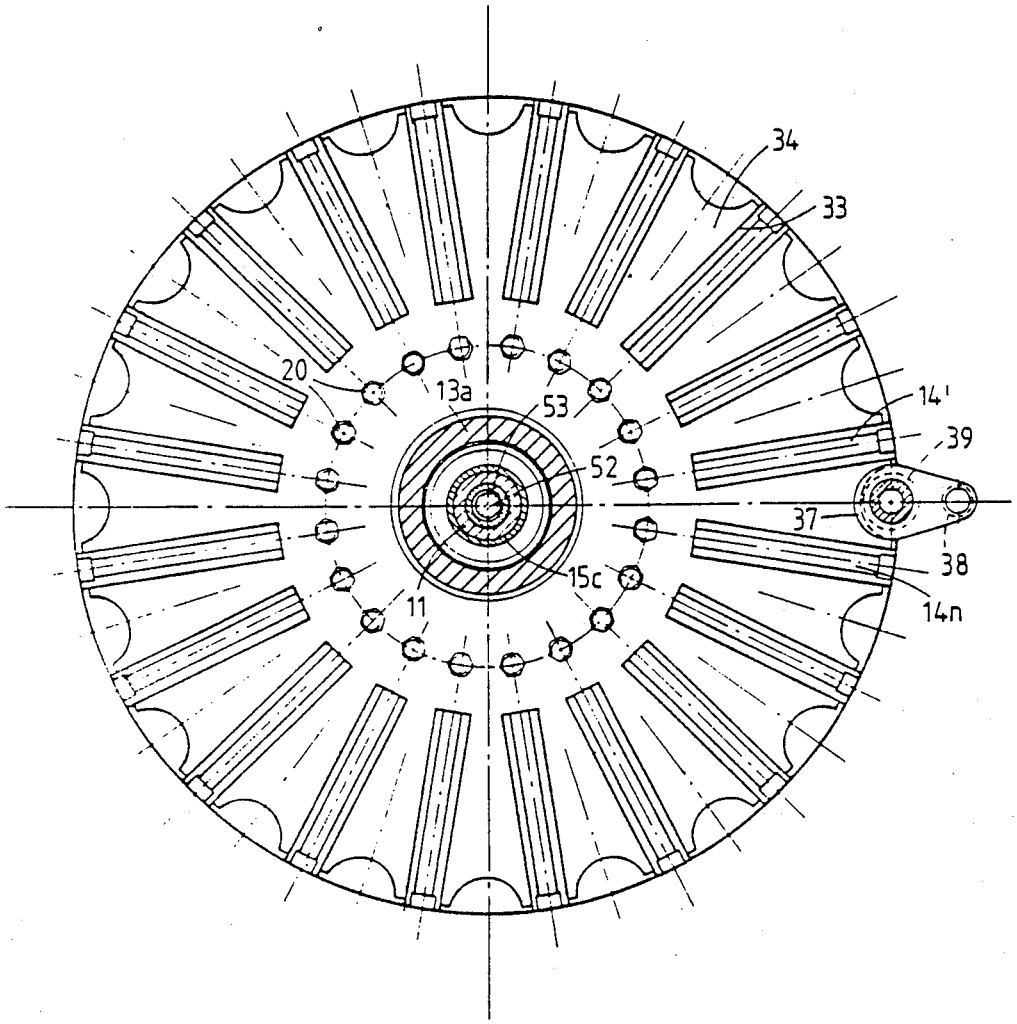
FIG. 4 is a cross-section along the line A—A of FIG. 2.

The rotating drum 13 (FIGS. 2 and 4) has a boss **13*a*, in the bore of which the bearings fitted on the sleeve, the body 13*b* and a ring gear 13*c* are provided. The body 13*b* is lightened by means of a plurality of slots or compartments 14', 14'', . . . 14$^n$**, which are essentially in form of rectangular parallelepiped vertically placed and extending in the radial direction after one another at the same reciprocal distance along the circumference.

Each compartment 14 is defined at its outer periphery by the relative arch portion of the ring gear **13*c* and at its inner side by a supporting flanged blade member 16 which as described hereafter is made integral with an annular rib 13*d* facing downwards and provided as integral part of the drum near the boss 13***a*. Each compartment is defined radially, i.e. at the other two opposite sides, by the facing portions of the body 13*b* which separate the compartments. At the upper and the lower sides each compartment is open and in particular at the upper side the vertical side walls are divergent upwards in a symmetric way, thus forming two small planes 18 and 19 one after the other having a different slope with respect to the vertical plane and acting as entrance mouth for the coins. The distance between the vertical side walls is relatively larger than the maximum thickness of the admissible coins. Each flanged blade member 16 integral with the annular rib 13*d* of the drum 13 is fastened thereto by a screw 20 which further connects by means of a centering disc 22 the drum 13 to a plate 21 of a Maltese cross mechanism which will be described afterwards. Each flanged blade member 16 can be made of metal sheet and has a cylindrical form at its engaging area 23 with the rib 13*d*, and in the flange 24 radially extending outwards a through-hole is formed for the fastening screw 20. Each flanged member 16 extends downwards with a pair of vertical arms 25 adjacent to the compartments 14, each pair of arms 25 supporting a rocking lever 26 hinged in 27 at its lower end. The position of each lever 26 can be changed from an essentially horizontal position, in which the lever forms the bottom of a compartment and then as a whole a housing retaining the coin 28 fallen therein, to an essentially vertical position, in which the lever allows the coin 28 to fall downwards. In such a way the compartment becomes a pocket. The operation of the rocking lever 26 will be described afterwards. The coins 28 incoming to the rotating drum magazine come from a feeding duct 29, at the lower end of which a sensor 30 is provided sensing the transit of a coin. A coding disc 32 of known type and not described here into greater detail is fitted at the upper end of the boss 13*a* of the drum 13 by means of a peg 31, said coding disc being able to detect the setting angle of the drum 13, i.e. to code the position of each compartment. The drum 13 is connected by means of screws 20 to the plate 21 of the Maltese cross mechanism. The plate 21 is divided by means of radial grooves 33 into a number n of lobes 34 (n=20 in FIG. 4). Each groove 33 of the plate 21 has a width larger than the width of the compartment 14. A retaining cylinder 39 together with a crank 37 with handle 38 supporting a self-lubricating roller 38*a* which fits into the grooves 33 of the plate 21 are fitted on a driving shaft 35 journalled by the supporting plate 10 and driven by a motor 36. At any turn of the driving shaft 35 the roller 38*a* sliding along the groove 33 rotates the plate 21 and then the drum 13 integral therewith by an angle of 360°/n, thus allowing a desired compartment of the drum to be placed at the output mouth of the feeding duct 29.

At the upper end of the sleeve 11 supporting the rotating drum 13 a flanged bush 40 coaxially rotating about the drum 13 is provided, the upper part of said bush being suitably fitted with rotating coupling to the upper flange 10*b* of the supporting plate channel 10. The flange 41 of the bush 40 is fixedly connected at the upper side by means of screws 43 to a coding disc 42 like the coding disc 32 of the drum 13 and at the lower side by means of screws 44 to a plate 45 of a Maltese cross mechanism having the same number of lobes as the above described one and being moved by a driving shaft 46 journalled by the supporting plate 10 and driven by a motor 47 by means of a crank 48 with handle 49 and retaining cylinder 50. At any turn of the driving motor 46, the handle 49 rotates the plate 45 and then the flanged bush 40. At the upper part of the bush 40 a connecting peg 51 connects the latter to a rod 52 and to an outer coaxial sleeve 53, both being rotatable coaxially to the bush 40.

The connecting peg 51 is housed into a slot 54 formed in the rod 52 and in the sleeve 53 so that both the latter can be displaced also vertically, i.e. in the direction of the rotation axis. The rod 52 extends both at the upper and the lower sides beyond the sleeve 53; at the upper end the rod 52 is made integral by means of a peg with a flanged nut 55 acting as a tie member for the rod when it is driven by a first electromagnet (not shown). Also the sleeve 53 at its upper end is provided with a flanged nut 56 with peg; the flanged nut 56 driven by a second electromagnet (not shown) is provided with a bored head for the rod 52, while the peg 57 passes through a slot 58 formed into the rod 52.

Within the bush 40 and coaxially to the sleeve 53 a spiral counter spring 59 is abuting between the upper surface of the bush 40 and an annular projection 60 formed on the sleeve 53.

Figure 5:
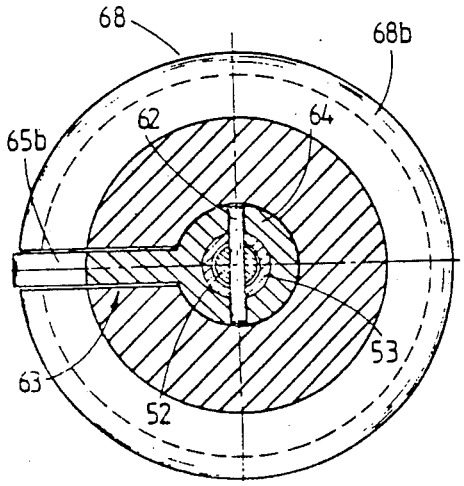
FIG. 5 is a cross section in enlarged scale along the line B—B of FIG. 2.

At the lower side a slot 61 is provided into the rod 52 but not into the sleeve 53, thus receiving a connecting peg 62 (FIG. 5) which makes the sleeve 53 integral with an arm member 63 and vertically slides through the rod 52 along the slot 61. The arm member 63 consists of a sleeve 64 surrounding the sleeve 53 and of a projecting portion having free ends essentially forming a fork, the upper prong 65*a* of which is shorter than the lower prong 65*b*. The rod 52 ends at the lower side in a cup member 66 which is connected to it by means of a connecting peg 67.

The cup member 66 supports a reel member 68 having an extension such as to be the supplement to 360° of the arm member 63 even if both members 63 and 68 are not integral with each other. In this case the reel member 68 consists of two plates placed over each other, the upper plate of which is designated by 68*a*, the lower by 68*b*. Because of their U-shaped form both members 63 and 68 operatively engage with their free ends the rocking levers 26 at the point at which the force acts as shown in FIG. 2 to cause the levers 26 to be operated according to the working conditions described herebelow.

A coin 28 coming from the slot of the telephone apparatus is recognized and validated by a conventional coin selection system and after being run through the feeding duct 29 is sensed before passing the end of the latter by a sensor 30 and falls down into the pocket compartment 14 which is underlying the output of the feeding duct 29. The pocket is normally closed because the rocking lever 26 takes a little slanting position with respect to horizontal plane in that it engages the upper prong 65*a* of the arm member 63 or the upper plate 68*a* of the reel member 68.

The pocket 14, into which the coin 28 is fallen, is defined by the relative address coded by the coding disc 32 integral with the rotating drum 13. This address defines the coin over the time during which it remains in the pocket. An electronic control unit stores this address along with the value of the coin transferred thereto by the coin selection system. If a further coin is put in the slot, the Maltese cross mechanism 35, 39 rotates the drum by a step equal to the distance between the axis of two adjacent pocket compartments. Beneath the end of the feeding duct an empty pocket ready to receive the further coin is placed. If all pockets of the drum are full, the further coins are given back to the user. The selection of the coin designed to be cashed or given back to the user during the operation, for example the telephone call, or at the end thereof is carried out by the automatic storing and managing magazine of the present invention by means of the rocking lever driving mechanism.

The arm 63 is integral with the lower end of the sleeve 53 which rotates by virtue of the peg connection to the flanged bush 40 which is rotated step by step in both directions by the Maltese cross mechanism 45-50 according to the coded address of the coding disc 42. Then the arm 63 controlled by the coding disc 42 reaches the position selected by the electronic control unit, i.e. it rotates up to the rocking lever associated to the pocket containing the coin selected to be cashed. The upwards shifting of the sleeve 53, which is caused by the nut 56 controlled by the above mentioned second electromagnet and is carried out along a path defined by the length of the slot 54, 58 and 61 of the rod 52, pushes the end of the rocking lever 26 resting on the arm 63 to enter the associated fork. The rocking lever 26 rotates downwards, thus opening the pocket, so that the coin falls down to either be cashed or given back to the user according to the operation of the logic control unit. This can be carried out one coin after the other for all coins contained in the magazine. When all coins have to be given back at the same time the upwards shifting of the rod 52, which is caused by the flanged nut 55 controlled by the above mentioned first electromagnet, allows in turn the arm member 63 and the reel member 68 to be lifted together, thus causing the opening of all pockets of the magazine. Such an opening is made possible also in case of emergency by means of a suitable linkage not described into detail.

The above described components can be modified according to their dimensions and/or shapes without departing from the scope of the present invention.

I claim:

1. A rotating drum magazine for storing and managing coins, in particular in a telephone apparatus or dispenser of public utility comprising: a feeding duct, for transporting coins within said magazine, a rotating drum (13), which is rotatable about a vertical axis and has a plurality of radially located compartments (14', 14'' . . . 14$^n$) able to receive coins (28) falling by gravity from the feeding duct (29), closure means for closing the bottom of said compartments to retain said coins including a rocking lever (26) hinged (27) near the bottom of the compartment to retain the coin received, driving means controlling the closure means for the selective opening of each compartment, said driving means being rotatable in two directions and logic control means for controlling the feeding of the coins from the drum, the bottom of each compartment of the drum being closed by the closure means rotating said rocking lever in a radial plane between a closed and opened position, said driving means being rotatable coaxially with the rotating drum, coding means for coding the angle through which said driving means has rotated, the logic control means controlling the rotation of the rotating drum and the driving means, and said rotating drum and the driving means controlling the closure means for the selective opening of the compartments at a plurality of positions.

2. Rotating drum magazine according to claim 1, characterized in that the rotating drum (13) is connected to a Maltese cross mechanism (21, 35-39) transmitting to the drum an intermittent step-controlled rotatory motion in both directions so that an empty compartment (14) is placed beneath the lower end of the feeding duct (29) to receive the coin.

3. The rotating drum magazine of claim 1, wherein said coding means includes a coding disc (32,42) integrally formed with said drum and said driving means and said coding means cooperating with said driving means to control the operation of the closure means.

4. A rotating drum magazine for storing and managing coins, in particular in a telephone apparatus or dispenser of public utility comprising: a feeding duct for transporting coins within said magazine, a rotating drum (13), which is rotatable about a vertical axis and has a plurality of radially located compartments (14', 14'' . . . 14$^n$) able to receive coins (28) falling by gravity from a feeding duct (29), closure means for closing the bottom of said compartments to retain said coins, driving means controlling the closure means for the selective opening of each compartment, said driving means being rotatable in two directions and logic control means for controlling the feeding of the coins from the drum, the bottom of each compartment of the drum being closed by the closure means rotating said rocking lever in a radial plane between a closed and opened position, said driving means being rotatable coaxially with the rotating drum, coding means for coding the angle through which said driving means has rotated, the controlling means controlling the rotation of the rotating drum and the driving means, and said rotating drum and the driving means controlling the closure means for the selective opening of the compartments at a plurality of positions; each closure means being a rocking lever (26) hinged (27) near the bottom of the compartment so as to retain the coin received, said driving means being disposed coaxially with each rocking lever (26) either alone or in concert with the rocking levers of other compartments.

5. The rotating drum magazine as claimed in claim 4, wherein said driving means controlling the closure engaging means includes a rod (52) and a sleeve (53) coaxial to each other said rod being formed with a first U shaped member thereon for selectively engaging each rocking lever, said sleeve being formed with a second U shaped member thereon for selectively engaging each rocking lever for controlling the rotation of said rod and said sleeve, a Maltese cross mechanism (45-50) lifting means for selectively lifting said rod and said sleeve together or separately from each other so that said compartments (14) are selectively opened by engagement of either all or only one lever (26) with said first and second U shaped members (63,68).

6. A rotating drum magazine for storing and managing coins, in particular in a telephone apparatus or dispenser of public utility comprising: a feeding duct for transporting coins within said magazine, a rotating drum (13), which is rotatable about a vertical axis and has a plurality of radially located compartments (14', 14'' . . . 14$^n$) able to receive coins (28) falling by gravity from the feeding duct (29) closure means for closing the bottom of said compartments to retain said coins, driving means controlling the closure means for the selective opening of each compartment, said driving means being rotatable in two directions and logic control means for controlling the feeding of the coins from the drum, the bottom of each compartment of the drum being closed by the closure means rotating said rocking lever in a radial plane between a closed and opened position, said driving means being rotatable coaxial with the rotating drum, coding means for coding the angle through which said driving means has rotated, the controlling means controlling the rotation of the rotating drum and the driving means; said rotating drum and the driving means controlling the closure means for the selective opening of the compartments at a plurality of positions; said driving means including a rod (52) and a sleeve (53) coaxial to each other said rod being formed with a first U shaped member for selectively engaging each rocking lever, said sleeve being formed with a second U shaped member for selectively engaging each rocking lever, a Maltese cross mechanism (45–50) for controlling the rotation of said rod and said sleeve, lifting means for selectively lifting said rod and said sleeve together or separately from each other, so that said compartments (14) are selectively opened by engagement of either all or only one lever (26) with said first and second U shaped members (63,68).

* * * * *